US009142898B2

(12) United States Patent
Guo

(10) Patent No.: US 9,142,898 B2
(45) Date of Patent: Sep. 22, 2015

(54) ROTARY USB INTERFACE DEVICE WITH CAPACITIVE COUPLING

(75) Inventor: Jian Guo, Shenzhen (CN)

(73) Assignee: ZTE CORPORATION, Shenzhen (CN)

( * ) Notice: Subject to any disclaimer, the term of this patent is extended or adjusted under 35 U.S.C. 154(b) by 154 days.

(21) Appl. No.: 14/000,716

(22) PCT Filed: Jul. 28, 2011

(86) PCT No.: PCT/CN2011/077733

§ 371 (c)(1),
(2), (4) Date: Sep. 16, 2013

(87) PCT Pub. No.: WO2012/113203

PCT Pub. Date: Aug. 30, 2012

(65) Prior Publication Data

US 2014/0017918 A1 Jan. 16, 2014

(30) Foreign Application Priority Data

Feb. 22, 2011 (CN) ..... 2011 1 0043533

(51) Int. Cl.
*H01R 39/00* (2006.01)
*H01R 12/70* (2011.01)
(Continued)

(52) U.S. Cl.
CPC ..... *H01R 12/7082* (2013.01); *H01R 13/6594* (2013.01); *H01R 35/04* (2013.01)

(58) Field of Classification Search
CPC ..... H01R 35/04
USPC ..... 439/31, 8, 9, 950; 455/575.3
See application file for complete search history.

(56) References Cited

U.S. PATENT DOCUMENTS 4,931,991 A * 6/1990 Cvijanovich ..... 365/52
5,936,841 A * 8/1999 Kantner et al. ..... 361/737
(Continued)

FOREIGN PATENT DOCUMENTS

CN 201156604 Y 11/2008
CN 201298604 Y 8/2009
(Continued)

OTHER PUBLICATIONS

Supplementary European Search Report in European application No. 11859174.2, mailed on Jul. 15, 2014.
(Continued)

*Primary Examiner* — Neil Abrams
(74) *Attorney, Agent, or Firm* — Oppedahl Patent Law Firm LLC

(57) ABSTRACT

Disclosed is a rotary USB interface device, which includes: a USB module (110), a PCB, a rotary shaft (130) connecting the USB module and the PCB, a conductive layer (140) connected with the rotary shaft, and an insulation layer (150) provided between a grounding layer (160) on the PCB and the conductive layer. The USB module contains a first ground wire, which forms a first grounding path of the USB module, together with the rotary shaft and the conductive layer. The grounding layer on the PCB forms a second grounding path. The first grounding path is separated from the second grounding path by virtue of the insulation layer, i.e. the grounding path of the PCB is separated from the grounding path of the USB module. Thus, an open circuit voltage is formed, the voltage difference is maintained stable, the overall device obtains a stable grounding signal, the grounding performance is enhanced and the transmitting/receiving performance of the device is improved.

12 Claims, 5 Drawing Sheets

(51) Int. Cl.
*H01R 13/6594* (2011.01)
*H01R 35/04* (2006.01)

(56) References Cited

U.S. PATENT DOCUMENTS

| | | | | |
|---|---|---|---|---|
| 6,272,324 | B1 * | 8/2001 | Rudisill et al. | 455/575.8 |
| 6,350,055 | B1 * | 2/2002 | Barras | 368/281 |
| 6,490,163 | B1 * | 12/2002 | Pua et al. | 361/737 |
| 6,786,734 | B2 * | 9/2004 | Yu | 439/11 |
| 7,001,193 | B2 * | 2/2006 | Zaderej et al. | 439/165 |
| 7,121,852 | B2 * | 10/2006 | Ng et al. | 439/131 |
| 7,422,439 | B2 * | 9/2008 | Rathburn et al. | 439/66 |
| 7,751,860 | B2 * | 7/2010 | Symons et al. | 455/575.3 |
| 7,828,599 | B2 * | 11/2010 | Zhao et al. | 439/607.34 |
| 8,121,657 | B2 * | 2/2012 | Hiraoka | 455/575.1 |
| 8,139,374 | B2 * | 3/2012 | Hiraoka | 361/803 |
| 8,189,332 | B2 * | 5/2012 | Kondu | 361/679.56 |
| 8,265,718 | B2 * | 9/2012 | Horihata et al. | 455/575.3 |
| 8,469,729 | B2 * | 6/2013 | Ding | 439/131 |
| 8,508,948 | B2 * | 8/2013 | Katou | 361/752 |
| 8,651,874 | B2 * | 2/2014 | Ku et al. | 439/31 |
| 8,929,062 | B2 * | 1/2015 | Xie et al. | 361/679.31 |
| 2010/0052024 | A1 | 3/2010 | Kiyomura et al. | |
| 2010/0210142 | A1 | 8/2010 | McGrath | |
| 2013/0045582 | A1 | 2/2013 | Kiyomura et al. | |
| 2013/0058058 | A1 * | 3/2013 | Park et al. | 361/752 |
| 2014/0017918 | A1 * | 1/2014 | Guo | 439/131 |
| 2015/0072539 | A1 * | 3/2015 | Xie | 439/13 |

FOREIGN PATENT DOCUMENTS

| | | | |
|---|---|---|---|
| CN | 201348880 | Y | 11/2009 |
| CN | 201466449 | U | 5/2010 |
| CN | 101820113 | A | 9/2010 |
| CN | 201584523 | U | 9/2010 |
| CN | 201601266 | U | 10/2010 |
| CN | 201682071 | U | 12/2010 |
| CN | 102083300 | A | 6/2011 |
| DE | 102005021803 | A1 | 12/2005 |
| JP | 2006166225 | A | 6/2006 |
| JP | 2008219340 | A | 9/2008 |
| WO | 2007099602 | A1 | 9/2007 |

OTHER PUBLICATIONS

International Search Report in international application No. PCT/CN2011/077733 , mailed on Dec. 1, 2011.

English Translation of the Written Opinion of the International Search Authority in international application No. PCT/CN2011/077733 , mailed on Dec. 1, 2011.

* cited by examiner

ROTARY USB INTERFACE DEVICE WITH CAPACITIVE COUPLING

TECHNICAL FIELD

The present disclosure relates to the field of communications, and particularly to a rotary USB (Universal Serial BUS) interface device in a terminal device.

BACKGROUND

During designing of a rotary USB interface data card, one of the essential factors for determining of low frequency indices of OTA (Over The Air) is to ensure good performance of the rotary USB interface. The connection ability of a wireless device to a network and the effect of a wireless device user on radiation and reception performance can be verified by an OTA test, and the OTA indices contain TRP (Total Radiated Power) and TIS (Total Isotropic Sensitivity). TRP evaluates radiation performance of the wireless device, and a greater TRP value indicates a better radiation performance of the wireless device. TIS evaluates reception performance of the wireless device, and a smaller TIS value indicates a better reception performance of the wireless device.

FIG. 1 is a 3D exterior view of a conventional rotary USB interface data card, in which the USB part can rotate about the PCB (Printed Circuit Board) part.

FIG. 2 is a top view of a rotary USB interface data card with a conventional grounding manner. FIG. 3 is a side view of the data card shown in FIG. 2. FIG. 4 is a 3D schematic view of the data card shown in FIGS. 2 and 3, including a partial enlarged view of a rotary part. With reference to FIGS. 2, 3 and 4, a grounding path of the data card mainly includes a ground wire 20 in the USB 10, a rotary shaft 30 in contact with the ground wire 20, a spring tab or presser tab 40 in contact with the rotary shaft 30, a ground wire 50 in a FPC (Flexible Printed Circuit) board or a cable, and an exposed copper covering grounding region 60 on a PCB 70 in connection with the spring tab or presser tab 40.

Generally speaking, the width of the ground wire 20 of the USB 10 and the width of the ground wire 50 in the FPC or cable are controlled by the size of the overall structure of the data card, and the rotary shaft 30, the spring tab or presser tab 40 and the copper covering grounding region 60 are connected with each other in generally a point contact manner, which lower the grounding performance of the data card. When OTA test is performed on the rotary USB interface data card in the relevant art, it is found that its TRP/TIS indices are relatively poor in the case of 800 MHz and 900 MHz. It can be seen that the grounding performance of the rotary USB interface data card directly affects the OTA low frequency indices of the antenna 80.

To enhance the grounding performance of the rotary USB interface data card, the structure of the rotary USB interface data card may be improved. FIG. 5 is a top view of an improved rotary USB interface data card in the relevant art, FIG. 6 is a side view of the data card shown in FIG. 5.

From the structure of the data card shown in FIG. 5 and FIG. 6 where the grounding manner is improved, it can be seen that:

The improved rotary USB interface data card shown in FIG. 5 and FIG. 6 introduces a shield cover 90, a conductive foam 102, a data card housing 103, and a conductive paint layer 101 sprayed on part of the data card housing 103, besides those components shown in FIG. 2. There exists in the improved data card a large connection area between the spring tab or presser tab 40 and the shield cover 90 via the conductive paint layer 101 and the conductive foam 102, forming a grounding loop, which somewhat improves the grounding effect of the data card itself, but the improved effect is not enough for the desired grounding performance of the data card. The OTA indices of the data card remain relatively poor and also the transmitting/receiving performance is not satisfactory. Furthermore, there still exists some defects in such a data card structure: on the one hand, the use of the conductive paint layer and the conductive foam increase the production cost of the data card; on the other hand, the introduction of the extra components results in complication of production process of the data card.

SUMMARY

An embodiment of the present disclosure provides a rotary USB interface device, which solves the problems that the structure of the rotary USB interface device in the relevant art is complicated, and the transmitting/receiving performance is unsatisfactory due to the poor OTA indices.

A rotary USB interface device includes:

an USB module, rotating relative to a PCB by means of a rotary shaft, wherein the USB module contains a first ground wire, wherein the first ground wire is connected to the rotary shaft and the rotary shaft is connected to a conductive layer, so as to form a first grounding path of the USB module, wherein an insulation layer is provided between a grounding layer on the PCB and the conductive layer, separating the first grounding path from a second grounding path formed by the grounding layer of the PCB.

In the above device, the thickness of the insulation layer, the value of the area of the conductive layer and the value of the area of the grounding layer may be set in accordance with an open circuit voltage which is formed when the first grounding path is separated from the second grounding path of the PCB.

In the above device, the insulation layer may be of an insulation material.

In the above device, the insulation layer may be the PCB.

In the above device, the conductive layer may be of a metal material or a conductible material.

In the above device, the metal material may be selected from any one of or any combination of the following materials: stainless steel and copper.

In the above device, the conductible material may include conductive cloth.

The advantageous effects of the present disclosure are:

in the rotary USB interface device provided in the embodiments of the present disclosure, the first grounding path of the USB module is separated from the second grounding path of the PCB by virtue of the insulation layer. Thus an open circuit voltage is formed, the voltage difference between the grounding path of the USB module and the grounding path of the PCB is maintained stable, the overall device obtains a stable grounding signal, the grounding performance is enhanced and the transmitting/receiving performance of the device is improved. The simple structure of the device overcomes defects of the complicated structure, the cumbersome production process and the expensive costs of the device in the relevant art. The device according to embodiments of the present disclosure is a simpler implementation solution with lower costs, greater producibility and easier operation, in comparison with the conventional means such as spraying conductive paint and adhering conductive foam.

DETAILED DESCRIPTION

In order to make the technical problem to be solved by the present disclosure, the technical solutions and the advantageous effects more clear and apparent, the present disclosure is explained in further detail below in connection with the accompany drawings and embodiments. It should be understood that, the embodiments described herein are only used for explaining the present disclosure, rather for limiting the present disclosure.

Figure 1:
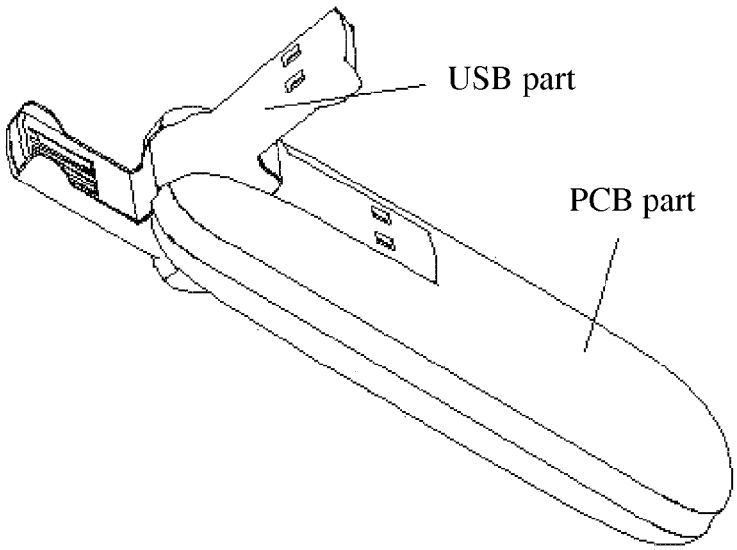
Fig. 1 (Prior Art)
FIG. 1 is a 3D exterior effect view of a conventional rotary USB interface device in the relevant art.
Figure 2:
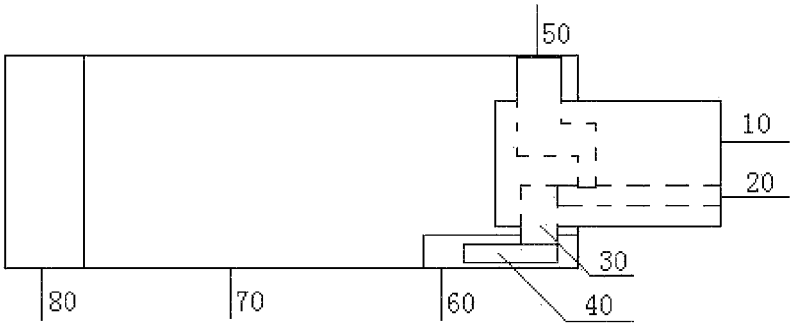
Fig. 2 (Prior Art)
FIG. 2 is a top view of a rotary USB interface device with a conventional grounding manner in the relevant art.
Figure 3:
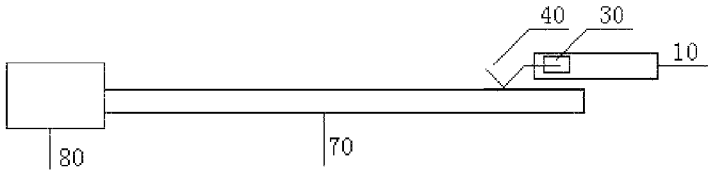
Fig. 3 (Prior Art)
FIG. 3 is a side view of the device shown in FIG. 2.
Figure 4:
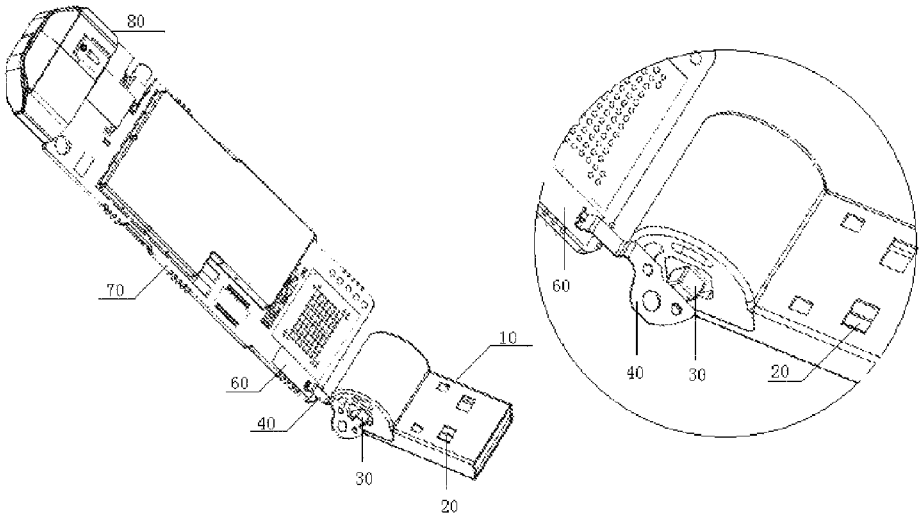
Fig. 4 (Prior Art)
FIG. 4 is a 3D schematic view of the device shown in FIG. 2 and FIG. 3.
Figure 5:
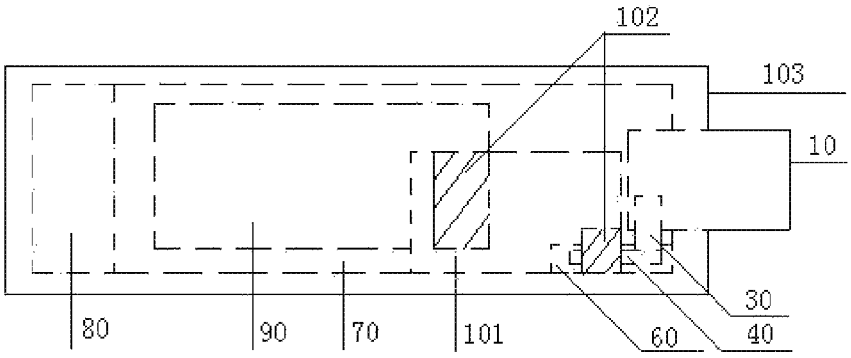
Fig. 5 (Prior Art)
FIG. 5 is a top view of an improved rotary USB interface device in the relevant art.
Figure 6:
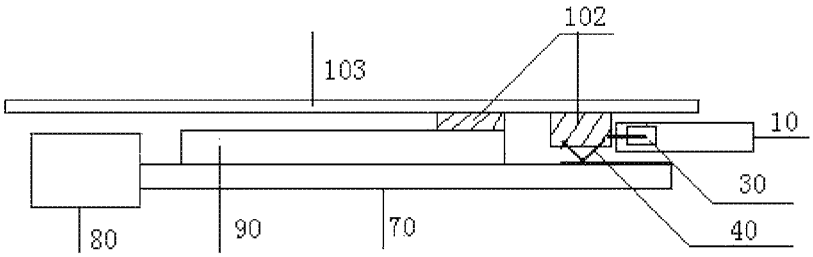
Fig. 6 (Prior Art)
FIG. 6 is a side view of the device shown in FIG. 5.
Figure 7:
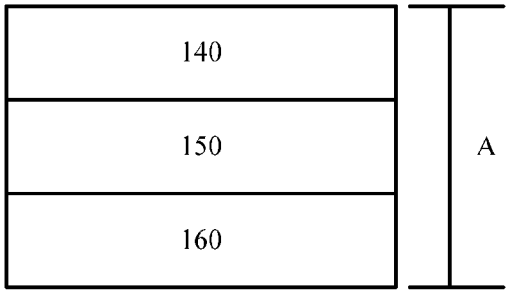
FIG. 7 is a schematic view showing the principle of the structure of a rotary USB interface device according to an embodiment of the present disclosure.

For the problems that the poor grounding performance of the rotary USB interface device in the relevant art results in poor OTA indices and poor transmitting/receiving performance of the device, the embodiments of the present disclosure provide a rotary USB interface device structure, which separates a first grounding path of an USB module of the device from a second grounding path of a PCB, to form an open circuit to maintain a stable voltage difference. The principle of structure of the rotary USB interface device is shown in FIG. 7. Preferably, the rotary USB interface device provided in the embodiments of the present disclosure may be a rotary USB interface data card.

As shown in FIG. 7, an insulation layer 150 is provided between a conductive layer 140 connected to a PCB module and a grounding layer 160 of a PCB, separating the second grounding path of the PCB from the first grounding path of the USB module, forming an open circuit voltage A. Said grounding layer 160 of the PCB may be an exposed copper covering grounding region of the PCB, or may be a metal carrier connected to the ground on the PCB.

By means of the insulation layer 150, the grounding layer 160 of the PCB and the conductive layer 140 are separated from each other, and an open circuit configuration is formed between the conductive layer 140 and the grounding layer 160. A stable voltage difference is maintained between the PCB and the USB module due to the open circuit configuration, so that low-frequency indices are improved and a desirable transmitting/receiving performance is obtained. The insulation layer 150 may be a PCB or other insulation materials.

The First Embodiment

Figure 8:
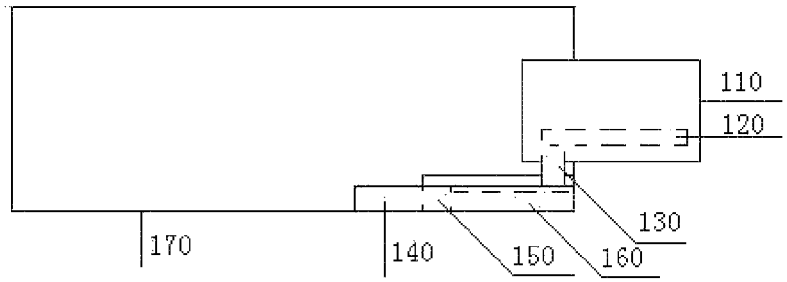
FIG. 8 is a top view of a rotary USB interface device according to the first embodiment of the present disclosure.
Figure 9:
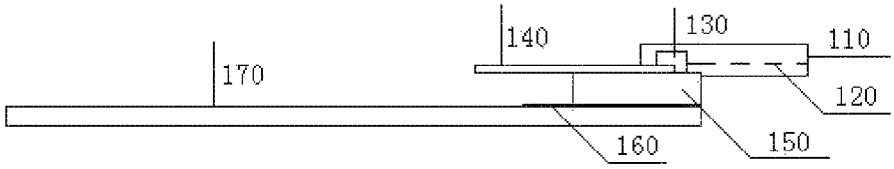
FIG. 9 is a side view of the device shown in FIG. 8.
Figure 10:
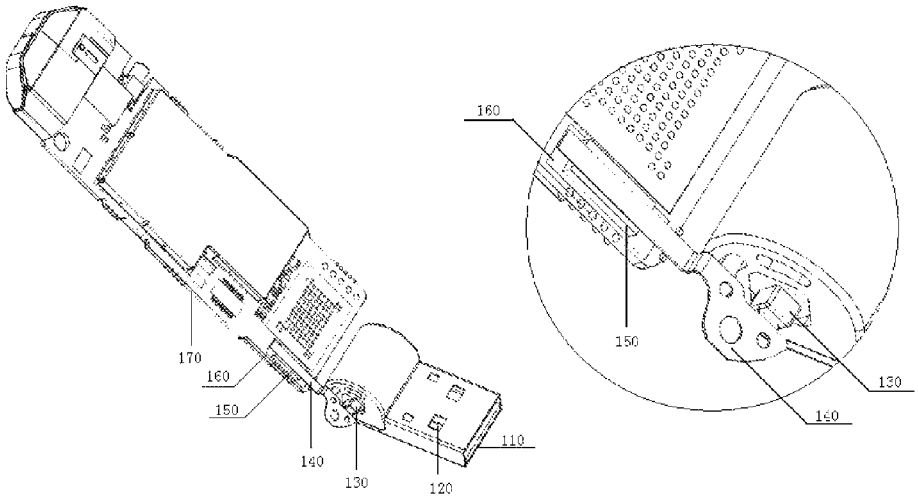
FIG. 10 is a 3D schematic view of the device shown in FIG. 8 and FIG. 9.

The structure of a rotary USB interface device provided in the first embodiment of the present disclosure is shown in FIG. 8, FIG. 9 and FIG. 10, wherein FIG. 8 is a top view of the rotary USB interface device, FIG. 9 is a side view of the device, and FIG. 10 is a 3D schematic view of the device. The rotary USB interface device includes: an USB module 110, a first ground wire 120 in the USB module 110, a rotary shaft 130, a conductive layer 140, an insulation layer 150, a PCB 170 and a grounding layer 160 on the PCB 170. In this embodiment, the grounding layer 160 is an exposed copper covering grounding region on the PCB 170.

In said rotary USB interface device, the USB module 110 is able to rotate relative to the PCB by means of the rotary shaft 130. The first ground wire 120 included in the USB module 110 is connected to the rotary shaft 130, and the rotary shaft 130 is connected to the conductive layer 140, such that a path is embodied in the conductive layer 140, the rotary shaft 130 and the USB module 110, and the first grounding path of the USB module 110 is formed, The insulation layer 150 is provided between the grounding layer (namely exposed copper covering grounding region) 160 on the PCB 170 and the conductive layer 140, separating the first grounding path from the second grounding path of the PCB 170. The grounding layer 160 on the PCB 170 forms the second grounding path on the PCB.

The thickness of said insulation layer 150, the value of the area of the conductive layer 140 and the value of the area of the grounding layer 160 are set in accordance with the open circuit voltage which is formed when the provided first grounding path is separated from the second grounding path of the PCB 170.

Said conductive layer may be of a metal material or a conductible material. The metal material may be selected from any one of or any combination of the following materials: stainless steel and copper, and the like. The conductible material may be selected from conductive cloth, and the like.

The Second Embodiment

Figure 11:
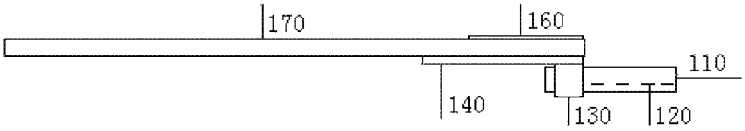
FIG. 11 is a side view of a rotary USB interface device according to the second embodiment of the present disclosure.

The structure of the rotary USB interface device provided in the second embodiment of the present disclosure is shown in FIG. 11, which is a side view of the device. The rotary USB interface device includes: an USB module 110, a first ground wire 120 in the USB module 110, a rotary shaft 130, a conductive layer 140, a PCB 170 and a grounding layer 160 on the PCB 170, wherein the PCB 170 is also used as an insulation layer at the same time, thereby there is no need to provide a specific insulation layer 150 as in the first embodiment.

In this embodiment, the USB module 110, the first ground wire 120 in the USB module 110, the rotary shaft 130 and the conductive layer 140 are provided on a side of the PCB 170 opposite to the grounding layer 160, so as to achieve a purpose that the PCB 170 serves as an insulation layer. By means of the PCB 170, the first grounding path of the USB module 110 formed by the conductive layer 140, the rotary shaft 130 and the first ground wire 120 in the USB module 110 is separated from a second grounding path formed by the grounding layer 160 on the PCB 170.

The rotary USB interface devices provided in said first and second embodiments establish an open circuit configuration between the grounding paths of the USB module 110 and the PCB 170 of the rotary USB interface device, so as to disconnect the first grounding path of the USB module 110 from the second grounding path of the PCB 170, such that an outer conductor of the USB module 110 has a voltage effect in an open circuit space state by means of the conductive layer 140 and the grounding layer 160 of the PCB 170, thus an open circuit voltage A is formed. If the value of the area of the conductive layer 140, the thickness of the insulation layer 150 and the value of the area of the grounding layer 160 of the PCB 170 are determined, the open circuit voltage A would maintain constant. In this way, a voltage uncertainty introduced by the rotary shaft 130 would be negligible as the presence of the voltage A, and therefore it is possible to decide that A becomes the main voltage difference of the overall data card structure. Accordingly, it is possible to determine the voltage difference between the first ground wire 120 of the USB module 110 and the grounding layer 160 of an outer metal wall and the PCB 170 by means of the open circuit voltage A, such that the grounding signal obtained by the overall data card structure tends to be stable. The reason why the OTA low-frequency indices, especially the TIS indices, of the rotary USB interface device in the relevant art is relatively poor is that point contact structure accumulation of a plurality of contact points causes instability and uncertainty of the grounding signal. In contrast, according to the embodiments of the present disclosure, an open circuit voltage A introduced by the open circuit configuration can maintain the stability of the grounding signal of the rotary USB interface device, thus improving the OTA low-frequency indices, especially the TIS indices.

The rotary USB interface devices provided in the embodiments of the present disclosure may be used in a terminal device or a wireless device of, such as, TD-SCDMA (Time Division-Synchronous Code Division Multiple Access) type, WCDMA (Wide-band Code Division Multiple Access) type, EVDO (Evolution Data Only) type. The purpose of maintaining the grounding signal stable is achieved by separating the first grounding path of the USB module from the second grounding path of the PCB. The simple structure of the device overcomes defects of the complicated structure, the cumbersome production process and the expensive costs of the device in the relevant art. The device according to embodiments of the present disclosure is a simpler implementation solution with lower costs, greater producibility and easier operation, in comparison with the conventional means such as spraying conductive paint and adhering conductive foam. At the same time, by means of the simple open circuit configuration, the TIS low-frequency indices of the rotary USB interface device is improved, the TRP performance of the device is ensured, and thus the desirable transmitting/receiving performance of the device is ensured.

The following table 1 shows TIS data of a rotary USB interface device obtained through tests, respectively, when employing the open circuit configuration provided in the embodiments of the present disclosure and employing the conventional configuration given in the relevant art.

TABLE 1

| | Channel (CH) | |
|---|---|---|
| | 62 | 124 |
| TIS of conventional configuration (dBm) | −96.77 | −95.29 |
| TIS of open circuit configuration (dBm) | −100.39 | −99.56 |

62 and 124 in table 1 are channel values, and dBm is the measurement unit of the TIS.

The following table 2 shows TIS data of another rotary USB interface device obtained through tests, respectively, when employing the open circuit configuration provided in the embodiments of the present disclosure and employing the conventional configuration given in the relevant art.

TABLE 2

| | Channel (CH) | | |
|---|---|---|---|
| | 1 | 62 | 124 |
| TIS of conventional configuration (dBm) | −98.61 | −97.76 | −97.55 |
| TIS of open circuit configuration (dBm) | −103.47 | −101.67 | −102.03 |

1, 62 and 124 in table 2 are channel values, and dBm is the measurement unit of the TIS.

It can be seen from the TIS data obtained through tests in the above Table 1 and Table 2 that, the TIS of the rotary USB interface device employing the open circuit configuration provided in the embodiments of the present disclosure is improved to a greater extent, thus the rotary USB interface device employing the open circuit configuration has a better transmitting/receiving performance than the conventional rotary USB interface device.

The above description illustrates and describes a preferable embodiment of the present disclosure, but as mentioned above, it should be understood that the present disclosure is not limited to thereto. What described and illustrated herein should not be considered as an exclusion of other embodiments, yet can be used for any other combinations, modifications and environments, and can be changed within the conception scope of the disclosure described herein by the above teaching or technology or knowledge in relevant arts. The alternations and modifications made by the person skilled in the art which do not depart from the scope of the disclosure should fall into the scope of protection defined by the appended claims of the disclosure.

What is claimed is:

1. A rotary Universal Serial Bus (USB) interface device, comprising:

an USB module, rotating relative to a Printed Circuit Board (PCB) by means of a rotary shaft, wherein the USB module contains a first ground wire, wherein the first ground wire is connected to the rotary shaft and the rotary shaft is connected to a conductive layer, so as to form a first grounding path of the USB module, and wherein an insulation layer is provided between a grounding layer on the PCB and the conductive layer, separating the first grounding path from a second grounding path formed by the grounding layer of the PCB.

2. The device according to claim 1, wherein the thickness of the insulation layer, the value of the area of the conductive layer and the value of the area of the grounding layer are set in accordance with an open circuit voltage which is formed when the first grounding path is separated from the second grounding path of the PCB.

3. The device according to claim 1, wherein the insulation layer is the PCB or is of other insulation materials.

4. The device according to claim 1, wherein the conductive layer is of a metal material or a conductible material.

5. The device according to claim 4, wherein the metal material is selected from any one of or any combination of the following materials: stainless steel and copper.

6. The device according to claim 4, wherein the conductible material comprises conductive cloth.

7. The device according to claim 2, wherein the conductive layer is of a metal material or a conductible material.

8. The device according to claim 3, wherein the conductive layer is of a metal material or a conductible material.

9. The device according to claim 7, wherein the metal material is selected from any one of or any combination of the following materials: stainless steel and copper.

10. The device according to claim 8, wherein the metal material is selected from any one of or any combination of the following materials: stainless steel and copper.

11. The device according to claim 7, wherein the conductible material comprises conductive cloth.

12. The device according to claim 8, wherein the conductible material comprises conductive cloth.

* * * * *